US006166231A

United States Patent [19]

Hoeksema

[11] Patent Number: 6,166,231

[45] Date of Patent: Dec. 26, 2000

[54] TWO PHASE EXTRACTION OF OIL FROM BIOMASS

[75] Inventor: Scot Douglas Hoeksema, Lexington, Ky.

[73] Assignee: Martek Biosciences Corporation, Columbia, Md.

[21] Appl. No.: 09/210,598

[22] Filed: Dec. 15, 1998

[51] Int. Cl.[7] ..... C11B 1/10

[52] U.S. Cl. ..... 554/12; 554/20

[58] Field of Search ..... 554/12, 20

[56] References Cited

U.S. PATENT DOCUMENTS

| | | | |
|---|---|---|---|
| 2,013,663 | 9/1935 | Malisoff | 196/24 |
| 2,548,434 | 4/1951 | Leaders | 260/428.5 |
| 2,601,674 | 6/1952 | Reman | 23/270.5 |
| 2,680,754 | 6/1954 | Stapelberg | 260/412.4 |
| 2,714,551 | 8/1955 | Pascal | 23/270 |
| 2,729,549 | 1/1956 | Reman et al. | 23/310 |
| 2,773,082 | 12/1956 | Chayen | 554/13 |
| 3,021,201 | 2/1962 | Upton | 23/272.5 |
| 3,535,354 | 10/1970 | Karnofsky | 554/20 |
| 3,983,008 | 9/1976 | Shinozaki et al. | 195/104 |
| 4,916,066 | 4/1990 | Akimoto et al. | 435/134 |
| 4,938,984 | 7/1990 | Traitler et al. | 426/580 |
| 4,980,065 | 12/1990 | Hsu | 210/632 |
| 5,041,245 | 8/1991 | Benado | 260/412.1 |
| 5,112,956 | 5/1992 | Tang et al. | 530/424 |
| 5,130,242 | 7/1992 | Barclay | 435/134 |
| 5,204,250 | 4/1993 | Shinmen et al. | 435/134 |
| 5,244,803 | 9/1993 | Mori et al. | 435/280 |
| 5,244,921 | 9/1993 | Kyle et al. | 514/560 |
| 5,278,325 | 1/1994 | Strop et al. | 554/12 |
| 5,281,732 | 1/1994 | Franke | 554/16 |
| 5,286,886 | 2/1994 | Van de Sande et al. | 554/192 |
| 5,338,673 | 8/1994 | Thepenier et al. | 435/134 |
| 5,374,657 | 12/1994 | Kyle | 514/547 |
| 5,380,826 | 1/1995 | Castor et al. | 530/422 |
| 5,397,591 | 3/1995 | Kyle et al. | 426/602 |
| 5,407,957 | 4/1995 | Kyle et al. | 514/547 |
| 5,492,938 | 2/1996 | Kyle et al. | 514/786 |
| 5,516,923 | 5/1996 | Hebert et al. | 554/12 |
| 5,525,746 | 6/1996 | Franke | 554/12 |
| 5,539,133 | 7/1996 | Kohn et al. | 554/20 |
| 5,558,781 | 9/1996 | Buchold et al. | 210/805 |
| 5,620,728 | 4/1997 | Langley et al. | 426/312 |
| 5,658,767 | 8/1997 | Kyle | 435/434 |
| 5,739,364 | 4/1998 | Franke | 554/16 |

FOREIGN PATENT DOCUMENTS

| | | |
|---|---|---|
| 517796 | 1/1993 | Japan . |

OTHER PUBLICATIONS

Christie, W.W., "Lipid Analysis", 2nd Edition, 1982, Pergamon Press, NY, pp. 17–23.

Stansby, Maurice E., "Fish Oils in Nutrition", 1990, Van Nostrand Reinhold, NY, pp. 43–43, 155–156, 163–167, and 172–174.

Internet Web Page Http://www.soluna.demon.co.uk/aroma/oils.htm, dated Aug. 12, 1998.

*Primary Examiner*—Deborah D. Carr
*Assistant Examiner*—Brian J. Davis
*Attorney, Agent, or Firm*—Brebeck Phleger & Harrison, LLP

[57] ABSTRACT

A method of separating edible oil from biological material is disclosed. A biomass slurry containing microbial material in an aqueous suspension is collected. The slurry is typically placed in a centrifuge and then in a homogenizer. The resulting slurry is fed into a contacting device, such as a packed column, and mixed with a solvent that is essentially immiscible in water, for example hexane. The solvent extracts the oil from the biomass slurry and then separates from the slurry. Edible oil is recovered from the solvent and further processed.

22 Claims, No Drawings

TWO PHASE EXTRACTION OF OIL FROM BIOMASS

BACKGROUND OF THE INVENTION

1. Field of the Invention

This invention is directed to an improved method of separating oil from biological material.

2. Description of Related Art

Many plants and plant-material, such as oil-seeds, cereal brans, beans, nuts, and microbial organisms, contain oils that can be useful for many commercial products. These oils are used in cooking, processing foods, cosmetics, lubricants, and a host of other useful products. Because of this high commercial demand, much work had been done in an attempt to improve oil extraction processes to make them more efficient and more suitable for mass extraction.

Numerous processes for the extraction of oil are known in the art. The most commonly used process is solvent extraction from a dried plant material. To use the conventional process, the plant material must already be dry. The plant material may be pretreated, for example, by flaking to facilitate penetration of the plant structure by a solvent, such as hexane, without creating fine particles. The dried, lipid-containing plant material is then contacted with the solvent that will dissolve the oil or other valuable lipids and extract them out of the material. Contact time is provided with the solvent typically by means of counter-current washing. The resulting mixture of solvent and lipid material (the miscella) is separated from the extracted plant material and fractionated to remove the solvent, leaving the lipid.

This process is problematic when applied to oil-containing microbial mass. To remove oils from the microbial biomass, the biomass must first be dried, e.g., by spray drying, then slurried in the solvent. Biomass is produced in a relatively dilute aqueous slurry (fermentation culture), which means drying is an expensive process. Additionally, the temperature profile during drying must be such that oil quality is not compromised. Conventional extract equipment, which rely on coarse screens to retain the oil-bearing material, is not designed to handle the particles produced by such means.

Second, the cells may need to be disrupted to permit adequate contact with the solvent. This cell disruption step generates a significant amount of fines which tend to be carried along with the product in the solvent. Consequently, before further processing, these fines must be removed by filtration, centrifugation, or a combination thereof. The fines clog equipment used in downstream processing steps and make extraction more difficult.

Third, the extracted biomass carries 10–50% hexane by weight with it. This hexane will contain some product, which is now lost. Additionally, the hexane must be substantially removed before the delipidated biomass can be disposed.

Extraction of oil from high moisture materials, including animal products, such as eggs, and microbial biomass, have been described using polar solvents that are partly or completely miscible with water (see, e.g., U.S. Pat. No. 5,112,956 to Tang, et al., and U.S. Pat. No. 5,539,133 to Kohn, et al.). In a separate and distinct technology, addition of polymers to water to create two immiscible phases, between which water soluble substances may be partitioned, are described in, e. g., U.S. Pat. No. 4,980,065 to Hsu. However, these processes are not fully satisfactory for efficient extraction of non-polar lipids, such as triglyceride oils, on a commercial scale.

Therefore, a need has arisen for a novel method of separating oil from biological material that overcomes the disadvantages and deficiencies of the prior art.

SUMMARY OF THE INVENTION

In accordance with a principle aspect of the present invention, it is a technical advantage of this invention to provide a novel method for separating edible oil from biological material.

Another technical advantage of this invention is that it provides a novel method for extraction of lipids, specifically edible oil, from microbial biomass. The invention uses an appropriate solvent to extract oil from relatively fine particles in an aqueous slurry without the need to dry the slurry or reform the material to create larger-sized particles.

Another technical advantage of this invention is that it provides a novel method for separating edible oil from biological material that overcomes the problems of conventional methods. When disrupting the biomass in an aqueous phase and extracting without further drying, the fines stay in the aqueous phase and do not contaminate the solvent. Therefore, additional treatment of the solvent to remove the fines may be avoided. Moreover, hexane can be more easily removed from the aqueous liquid. Although hexane is soluble in water up to 3%, this hexane may be easily removed by heating the aqueous liquid.

These and other technical advantages are provided through one or more of the following embodiments. In one embodiment, a method for separating oil from biological material includes: providing biological material containing oil in an aqueous suspension; contacting a solvent with the aqueous suspension of biological material, the solvent being essentially immiscible in water; collecting the solvent, which now contains oil extracted from the aqueous suspension of biological material; and separating the oil from the solvent. Typically, the aqueous slurry will have less than 50% solids (w/w), preferably less than 35% solids.

In another embodiment, a method for separating oil from biological material includes: providing biological material containing oil in an aqueous suspension; adding an alkali to the aqueous suspension of biological material, wherein the pH of the aqueous suspension is greater than 4; contacting a solvent with the aqueous suspension of biological material; collecting the solvent, which now contains oil extracted from the aqueous suspension of biological material; and separating the oil from the solvent.

In another embodiment, a method for separating oil from biological material includes: providing biological material containing oil in an aqueous suspension; centrifuging the aqueous suspension of biological material; treating the aqueous suspension of biological material to disrupt its cell structure; increasing the pH of the aqueous suspension to be greater than 5 after disrupting the aqueous suspension; contacting a solvent with the aqueous suspension of biological material; collecting the solvent, wherein the solvent contains oil extracted from the aqueous suspension of biological material; and separating the oil from the solvent.

Other objects and advantages of the invention are set forth in part in the description which follows, and in part, will be apparent from this description, or may be learned from the practice of the invention.

DETAILED DESCRIPTION OF THE EMBODIMENTS

This invention depicts a method for separating oil from biological material. The present invention is particularly suitable for extraction of food grade oils, such as edible oils, however, the method of the present invention may be used for other oils, such as drying oils and other lipid-containing materials. In a particular embodiment, the invention relates to a process whereby oil is extracted from an aqueous slurry containing microbial material, or biomass, from a fermentation process. This embodiment typically involves concentrating an aqueous suspension of microbial cells, optionally disrupting the cells, and then contacting the resultant slurry with a solvent appropriate for the extraction of the product oil from the biomass slurry, wherein the solvent is essentially immiscible in water. Preferably, the contact occurs in a counter-current fashion. Thus, in this invention, two phases are used to facilitate removal of the oil from the biomass: a solvent phase, such as hexane, in which the oil is soluble; and an aqueous phase which retains the largely non-lipid portion of the biomass. In contrast to some analytical methods, which require dispersing oil-containing particles in a single phase containing a water-miscible organic solvent and then adding an immiscible solvent to break the mixture into two phases, the present process maintains two phases throughout.

According to this invention, the oil is originally in biomass in an aqueous slurry or suspension. There are numerous known methods of obtaining such lipid-containing biomass. For example, U.S. Pat. No. 5,658,767 to Kyle; U.S. Pat. No. 5,407,957 to Kyle et al.; U.S. Pat. No. 5,397,591 to Kyle et al.; U.S. Pat. No. 5,374,657 to Kyle et al.; and U.S. Pat. No. 5,244,921 to Kyle et al. disclose methods of obtaining oil-containing microbial biomass. Additionally, U.S. Pat. No. 4,916,066 to Akimoto; U.S. Pat. No. 5,204,250 to Shinmen et al.; U.S. Pat. No. 5,130,242 to Barclay; and U.S. Pat. No. 5,338,673 to Thepenier also disclose methods of obtaining oil-containing biomass. These and other known methods of obtaining a biomass slurry can be used, or alternatively, other sources of lipid-containing microbial biomass known in the art may be used. The biomass slurry can be comprised of microbial cells, such as algae, yeast or bacteria. Alternatively, the slurry may comprise fungal materials such as mycelia, hyphae, or it may contain other lipid-containing plant or animal materials.

Generally, the lipid-containing biomass slurry is from raw materials containing significant amounts of moisture. Microbial biomass is typically produced in culture broth composed of 3–4% dry solids and 96–97% moisture. The lipid-containing slurry can contain normal plant sources of vegetable oils: the process of this invention may be used to extract oil from aqueous slurries of ground oilseeds such as soybean, cottonseed, sunflower seed, rape seed, oleaginous vegetable material, cacao beans, peanuts, and the like. However, these materials are normally available as dry products and consequently the need to add water to produce a slurry of these materials obviates one of the benefits of the present invention. On the other hand, the method of this invention may be particularly suited for oil-containing plant materials that occur in high moisture streams, such as corn germ, avocado, olive, coconut, or other oil-containing fruit seeds (see U.S. Pat. No. 4,938,984 to Traitler et al.).

It is generally advantageous to reduce the volume of the biomass slurry before extraction. Centrifuging can increase the solids content of the biomass slurry. The biomass can be concentrated, for example, using a harvest centrifuge, which, typically may be a continuous flow centrifuge or a decanter. Typically, the biomass slurry leaving the centrifuge has solids content of 50% or less. Preferably, the exiting slurry retains enough water to make the slurry pumpable, which is typically a moisture content of 65% or greater. In a typical biomass slurry, the aqueous content of the slurry is between 70–90%, leaving the slurry at 10–30% solids, depending on the organism, the processing equipment used and the characteristics of the fermentation broth.

The biomass slurry is then placed in intimate contact with a solvent which is essentially immiscible with water. Suitable solvents include non-polar organic liquids, especially aliphatic hydrocarbons, such as hexane or various petroleum ethers. Other solvents within the contemplation of the invention include esters, ethers, ketones, and nitrated and chlorinated hydrocarbons, so long as the solvents are immiscible with water. In a preferred embodiment, the solvent is a food grade solvent. While mixtures of solvents are not necessarily outside the scope of this invention, mixtures of solvents that are miscible with water are not contemplated. In particular, addition of solvents which partition between water and organic solvents to leave a major part of the solvent in the water phase is not contemplated in this invention. Thus, mixtures of solvents that include aliphatic or acyl alcohols are outside this invention. Typically the ratio of solvent to water is from 1:1 to 6:1; the ratio of solvent to oil is typically 5:1 to 100:1, preferably 15:1 to 30:1.

Extraction is more efficient from smaller biomass particles, however, small particle slurries introduce handling problems in most edible oil processing procedures. The two-phase liquid extraction process of this invention is much more suitable for handling small particles. "Two-phase" as discussed herein refers to the liquid components, without regard to small particulates that may be found in either or both phases or outside either. The biomass slurry will typically have particles with sizes that are less than or equal to 100 microns. The process is suitable for slurries where the particles sizes are under 10 microns, even for particles from 1–2 microns or less in size. In particular, the method of this invention is suitable for particulate materials in which the size distribution includes at least 80% of the particles being less than 10 microns and at least 50% of the particles being less than 5 microns.

The biomass may be disrupted prior to or during extraction to facilitate contact between the solvent and areas of the biomass where lipid is concentrated. Disrupting the biomass slurry can be accomplished with, for example a grinder, a mill, or a homogenizer. In a homogenizer, the slurry is forced through the homogenizer under sufficient pressure to substantially disrupt all of the cells. The homogenizer breaks up the cells in the biomass slurry, allowing many of the components inside the cells to be released and may release the desired oils. For example, to disrupt dinoflagellate cell mass, the slurry may be forced through a MICROFLUIDICS™ homogenizer at 10,000 to 12,000 psi. Internal to this homogenizer, the slurry is split into two separate streams and the two streams intersect, causing physical disruption and/or homogenization. This efficiently breaks up the material to facilitate easy oil removal. For other cells, the slurry may be forced through the homogenizer from between 7,500 to 14,000 psi. The homogenizer can be used either before or after addition of the solvent. It is preferable to use the homogenizer before adding the solvent, because cells without the solvent added are less diluted, and using concentrated cell slurry in the homogenizer results in better production rates.

Contact between the solvent and the biomass slurry may be achieved by any process that allows for the intimate mixing of the aqueous and solvent phases and subsequent separation. An example of a method of contacting and separating liquid phases by settling which could be used is described in U.S. Pat. No. 2,729,549 to Reman.

Alternatively, a mechanically agitated column, in-line mixer, tank or any other liquid contact apparatus or device are all appropriate pieces of equipment to use for insuring intimate contact between the aqueous slurry and solvent phases.

In the preferred mode, the biomass slurry is pumped into a mixing container, which may be a stirred reactor, an in-line mixer, or a column, more preferably a packed column. Using a packed column during the process step allows mixing and separation of the phases in the same vessel. The column can be packed with any known packing material that facilitates mixing and contact between the phases. For example, the column can be packed with metal or ceramic rings or disks formed into saddles.

When using a packed column, the biomass slurry is pumped or poured into the top of the column through a dispersing plate. Hexane, or other solvent that is essentially immiscible in water, is forced into the bottom of the column. Due to the relative densities of the two liquids, and the fact that they are essentially immiscible, the aqueous phase (from the biomass slurry) will settle to the bottom of the column and the hexane phase will rise to the top. The present invention can work with either the hexane as the continuous phase or the biomass slurry as the continuous phase, although, typically, the hexane is the continuous phase. For a solvent with density greater than water, the solvent would be introduced at the top of the column and the aqueous slurry at the bottom.

As the aqueous phase settles through the solvent phase to the bottom of the column, oil will move out of the aqueous phase and be concentrated in the solvent phase. Subsequent to the contact, the microbial biomass can be collected in a container at the bottom of the column, or concentrated in a decanting centrifuge or a settler. The solvent, with the oil, may be recovered from the top of the column. Thus, the oil has been transferred into the solvent, and the solvent and oil mixture (miscella) can be recovered.

The aqueous biomass slurry can be run through multiple columns to achieve more efficient oil extraction. Every time the slurry is run through a column, counter-current to solvent, more oil is extracted. For example, after once extracting the aqueous slurry, the slurry is then run through a second column (or the same column) against a different or the same batch of solvent, and the process is repeated. The solvent and slurry may be recycled through the same column with effect similar to extending the length of the column.

If using alternative methods of mixing, the phases can be separated in numerous ways. For example, a settling tank, decanting centrifuge, or any other separation method or device based on differential densities can be used. Alternatively, a two-phase centrifuge or a three-phase centrifuge can be used.

Preferably, the process is run at room temperature or above. It is preferable not to use temperatures above the temperature at which the solvent, e.g., hexane, boils, i.e., less than 60° C. at atmospheric pressure. Additionally, it is preferably to exclude oxygen while running the process. This helps reduce oxidation of the lipids in the extractor.

Surface active compounds ("surfactants") may be used to help control droplet size. If used, it is preferred that no skin is created on the drop and that little or no extraction of the surfactant into the solvent phase occurs. Surfactants are added in only minor amounts, thus the surfactant will not produce an emulsion or form a single phase from the solvent and water.

Crude oil extract is obtained by removing the solvent from the miscella by any known method. For example, the solvent and oil can be separated into two phases by heating the miscella until the solvent boils off, so just the oil phase remains. Alternatively, the solvent can be removed from the miscella by vacuum distillation. The oil can then be further purified and processed by normal edible oil processing steps. Such normal processing is disclosed in, for example, U.S. Pat. No. 5,286,886 to Van de Sande et al.

After collecting the crude oil, the oil can be run through routine de-gumming to remove phospholipids. Additionally, the oil can go through alkali refining to remove free fatty acids. Alkali refining typically involves adding caustic that is 1.2 to 1.5 times the amount required to neutralize free fatty acids in the oil, and separating the resulting soaps. In a preferred mode, oleic acid can be added to the oil to increase the free fatty acids. This will facilitate removal of the phospholipids or any other phosphorus bearing compound in the oil. Alternatively, the free fatty acids can then be removed using alkali refining, typically with an increased excess of caustic, for example a 3-fold excess.

Further, the oil can be bleached to remove color bodies, residual soaps, and metals, and to convert oxidation products to forms more easily removed by the deodorizer. For example, activated silica, such as TRISYL® (from Grace Davidson, a division of W. R. Grace & Co.), or bleaching clay can be added to bleach the oil.

The oil may be chilled, or winterized for a period of time, typically after bleaching. Winterizing the oil helps remove saturated fats. To winterize the oil, it is put in a holding tank and kept at low temperatures until the saturated fats crystallize. For example, the oil can be chilled for 12 hours at 16° C. After chilling the oil, the oil can be filtered to remove solids, solidified saturated fats, and solidified triglycerides, and then deodorized. The oil is deodorized typically using steam stripping. Preferably, the oil is brought to a temperature of 210–220° C. for highly unsaturated oil, and for other vegetable oils to temperatures up to 265° C. Moreover, the extracted oil product can be taken through additional conventional steps to improve the end product.

In another embodiment of the present invention, oil extraction is improved by increasing the pH of the biomass slurry. The increase in the pH can be achieved by any conventional method of increasing the pH in a biomass slurry. For example, an alkali or a food grade caustic solution can be added to the biomass slurry.

Typically the slurry has an acidic pH, for example a pH of 6–7 as it exits the fermenter and a pH of 4–5 as it exits the harvest centrifuge. The oil extraction process is improved by increasing the pH to above 5. More preferably, the process can be improved by raising the pH of the slurry to between 5 and 10. It is preferred not to use a pH that is high enough to saponify the oil. The pH of the slurry can be increased by adding a caustic solution, such as potassium hydroxide or sodium hydroxide.

Mixtures of biomass and hexane may have a tendency to emulsify, and increasing the pH helps improve oil extraction because at preferable pH levels, the emulsion will tend to break into two phases. Additionally, the preferable pH levels helps improve droplet formation during extraction. Furthermore, preferable pH levels positively affects the behavior of the aqueous slurry. This allows better counter-current flow through the columns, or alternatively) improves mixing. Accordingly, the addition of alkali to the aqueous phase improves the percentage of oil recovered from the process.

EXAMPLES

Example 1

Two-Phase Extraction of Oil from Microbial Biomass

Edible oil may be extracted from biomass slurry obtained by the method described in U.S. Pat. No. 5,492, 938 to Kyle et al. The slurry is processed in a harvest centrifuge to raise the solid concentration of the mixture to 14–20% w/w. The slurry is then processed in a MICROFLUIDICS™ homogenizer where the cell material is lysed to facilitate more efficient oil extraction. The lysed cell slurry is pumped into the top of a packed column. The column is a glass column and is 6 inches in diameter and 5 feet tall and is packed with 50 inches of ⅝-inch metal disks formed into saddles. The slurry is poured in the top of the column through a dispersing plate, and hexane flows up from the bottom. Due to the relative densities of the two liquids, and the fact that they are essentially immiscible, the aqueous phase will settle to the bottom of the column and the hexane phase will rise to the top. As this occurs, oil will move out of the aqueous phase and be concentrated in the hexane phase. The oil is transferred into the hexane and subsequently purified and refined by normal edible oil processing steps.

Additionally, two or more columns can be placed in series next to each other. When the aqueous phase is collected from the bottom of the column, it is pumped into the top of the next column for further extraction. The aqueous slurry can thus be run through multiple columns to achieve more efficient oil extraction (see Table 1). The extraction percentage may be determined by monitoring total fatty acids in the aqueous slurry.

The extraction percentage, or extraction efficiency, is determined by comparing the oil content of the biomass before extraction with the oil content of the biomass after extraction. The oil content after extraction is referred to as the residual oil.

The oil content is determined by freeze drying an aliquot of the aqueous slurry. A portion of the freeze-dried biomass is weighed out. The mono-, di- and tri-glycerides are converted to methyl esters of the free fatty acids and extracted from the biomass using a combination of acidified methanol, potassium carbonate, and toluene. An internal standard is used in the process. The extracted methyl esters are resolved using a gas chromatograph. The total area percent of the fatty acids is converted to a weight by utilizing the internal standard. This weight corresponds to the weight of the oil in the dried biomass. The methyl group on the fatty acids contributes essentially the same weight as the glycerol backbone of the oil and thus does not need a correction factor. For comparison, hexane extraction of dry microbial biomass containing 18–20% oil removed 76–82% of the oil, leaving the biomass with residual oil of 3–5% w/w.

Additionally, the residual free fatty acids and phospholipids may be measured each time through the column (see Table 2). Phospholipid content of oil is typically monitored by its correlation with the total phosphorous content of the oil. When dry biomass is extracted with hexane, the miscella typically is found to have between 100–700 ppm of phosphorous. The phosphorus content of the oil obtained by hexane extraction of the aqueous biomass, as described herein, ranged from 6–50 ppm of phosphorous. With repeated extractions by rerunning the aqueous solution through a second packed column, more phospholipids were extracted into the oil. Accordingly, as the number of passages through the column increases, there is an increase in the quantity of oil recovered, but it is less clean.

TABLE 1

Stage Efficiency

| Number of Times Through the Column | Residual Oil in Biomass (%) | Percent of original oil remaining | Extraction Percentage |
|---|---|---|---|
| 1 | 9.52 | 50% | 50% |
| 2 | 6.59 | 35% | 65% |
| 3 | 4.43 | 23% | 77% |
| 4 | 3.89 | 21% | 79% |
| 5 | 3.98 | 21% | 79% |
| 6 | 3.50 | 19% | 81% |

TABLE 2

Phosphorus Content of Extracted Oil

| Number of times through column | Phosphorus Content (ppm) |
|---|---|
| 1 | 50 |
| 2 | 115–118 |
| 3 | 197 |
| 4 | 216 |
| 5 | 358 |

Example 2

Oil Extraction is Affected by the pH.

Two identical samples, with different pH levels, produced different extraction results. Two aliquots of 150 g of biomass slurry were stirred with 450 g of commercial hexane. The hexane:water ratio was 3:1. The initial oil in the biomass was 18.9%. In one of the solutions, a 16% caustic solution was added to the slurry, to make the pH of the solution 9 (the pH should not get as high as 11, as that makes the slurry viscous). Both samples were stirred at room temperature for the same length of time. After extraction, the first sample had a residual oil concentration of 12.8%. The second sample (the pH adjusted sample) had a residual oil concentration of 4.6%. This corresponds to 32% and 75% oil recovery, respectively. Accordingly, batch-wise extraction of the solution with the higher pH had a higher yield of extracted oil.

Example 3

Batch-wise Extraction of Oil from Biomass

The oil was also extracted using a tank and centrifuge in a batch-wise extraction procedure. The slurry was fed into a MICROFLUIDICS™ homogenizer and then collected in a tank. The pH of the slurry was then adjusted to 9. Hexane was poured into the tank, and the resulting mixture was stirred for approximately two hours. The mixture was subsequently fed into a centrifuge to assist in separation of the phases. The upper phase, or miscella (the hexane and extracted oil) was then collected off the top. The heavy phase, the remaining slurry of biomass, was collected and placed back in the tank for re-extraction. After three repetitions of contacting the slurry with fresh hexane in the tank, a total extraction percentage of 84–85% was achieved.

Example 4

Batch-wise Extraction with pH Adjustment

The oil was also extracted using a tank and centrifuge in a batch-wise extraction procedure. The slurry was fed into a MICROFLUIDICS™ homogenizer, individual aliquots were collected, and the pH was adjusted to the levels indicated in Table 3 (see Table 3). The individual aliquots were stirred with five parts hexane for approximately two hours. The mixture was centrifuged to assist in separation of the phases. The miscella was then collected off the top. The yield was then determined by measuring residual oil in the aqueous phase (see Table 3).

TABLE 3

Effect of pH on Extraction Efficiency

| pH of Aqueous Extraction | Residual Oil in Biomass (%) | Extraction Percentage |
|---|---|---|
| 1.98 | 19.67 | 0 |
| 4.00 | 17.26 | 12 |
| 5.57 | 10.56 | 46 |
| 8.00 | 16.35 | 17 |
| 10.02 | 17.19 | 12 |
| 12.00 | 17.64 | 10 |

Example 5

Particle Size Distribution

The particle size distribution was performed on an algal aqueous slurry prepared as described in Example 1. The moisture content of the aqueous extraction was 86%, or 14% dry solids (w/w). After running the aqueous slurry through the homogenizer, the particle size distribution for the slurry was tested using a Coulter Counter (see Table 4).

TABLE 4

Particle Size Distribution

| Channel | Particle Diameter (microns) | Run 1 | Run 2 | Run 3 | Average | Percent of Total (%) | Accum Percent (%) |
|---|---|---|---|---|---|---|---|
| 1 | 1.3 | 0 | 0 | 0 | 0 | 0.0 | 0.0 |
| 2 | 1.6 | 4372 | 4603 | 4722 | 4566 | 5.9 | 5.9 |
| 3 | 2.0 | 7108 | 7751 | 7935 | 7598 | 9.9 | 15.8 |
| 4 | 2.5 | 13020 | 13532 | 14066 | 13539 | 17.6 | 33.4 |
| 5 | 3.1 | 15315 | 15889 | 16295 | 15833 | 20.6 | 53.9 |
| 6 | 4.0 | 14529 | 14922 | 15252 | 14901 | 19.4 | 73.3 |
| 7 | 5.0 | 8467 | 8383 | 8000 | 8283 | 10.8 | 84.1 |
| 8 | 6.3 | 3105 | 3179 | 2849 | 3144 | 4.1 | 88.1 |
| 9 | 7.9 | 22063 | 1692 | 1393 | 1716 | 2.2 | 90.4 |
| 10 | 10.0 | 1597 | 1355 | 1201 | 1384 | 1.8 | 92.2 |
| 11 | 12.6 | 1474 | 1232 | 1105 | 1270 | 1.6 | 93.8 |
| 12 | 15.8 | 2732 | 2608 | 2383 | 2574 | 3.3 | 97.2 |
| 13 | 20.0 | 1912 | 1846 | 1706 | 1821 | 2.4 | 99.5 |
| 14 | 25.1 | 201 | 249 | 237 | 229 | 0.3 | 99.8 |
| 15 | 31.7 | 80 | 86 | 79 | 82 | 0.1 | 99.9 |
| 16 | 39.9 | 58 | 58 | 53 | 56 | 0.1 | 100.0 |
| Total | — | — | — | — | — | 100.0 | 100.0 |

For purposes of clarity of understanding, the foregoing invention has been described in some detail by way of illustration and example in conjunction with specific embodiments, although other aspects, advantages and modifications will be apparent to those skilled in the art to which the invention pertains. The foregoing description and examples are intended to illustrate, but not limit the scope of the invention. Modifications of the above-described modes for carrying out the invention that are apparent to persons of skill in edible oil extraction and processing are intended to be within the scope of the invention, which is limited only by the appended claims.

All publications and patent applications mentioned in this specification are indicative of the level of skill of those skilled in the art to which this invention pertains. All publications and patent applications are herein incorporated by reference to the same extent as if each individual publication or patent application was specifically and individually indicated to be incorporated by reference.

I claim:

1. A process for separating lipids from microbial material, which comprises:

(a) contacting a solvent with an aqueous suspension of microbial material containing lipids in a counter-current manner, wherein the solvent is essentially immiscible in water;

(b) collecting the solvent, wherein the solvent contains lipids extracted from the aqueous suspension of microbial material; and (c) separating the lipids from the solvent.

2. The process of claim 1, wherein the microbial material in the aqueous suspension comprises fine particulate matter less than 10 microns.

3. The process of claim 1, wherein the microbial material comprises cells.

4. The process of claim 3, further comprising the step of: disrupting the cells in the aqueous suspension of microbial material prior to collecting the solvent.

5. The process of claim 4, wherein the step of disrupting the cells occurs in a homogenizer.

6. The process of claims 4, wherein both the step of disrupting the cells and the step of contacting the solvent occur in a homogenizer.

7. The process of claim 1, wherein the aqueous suspension is at a concentration less than 50% solids.

8. The process of claim 1, wherein the aqueous suspension is at a concentration less than 25% solids.

9. The process of claim 1, wherein the aqueous suspension is pumpable.

10. The process of claim 1, wherein a caustic is added to the aqueous suspension prior to collecting the solvent.

11. The process of claim 1, wherein the aqueous suspension has a pH between 5 and 10.

12. The process of claim 1, wherein the solvent contacts the aqueous suspension in a packed column.

13. The process of claim 1, wherein the microbial material comprises fungal material.

14. The process of claim 1, wherein the solvent comprises hexane.

15. A process for separating lipids from microbial material, which comprises:

(a) adding an alkali to an aqueous suspension of microbial material containing lipids, wherein the pH of the aqueous suspension is greater than 5;

(b) contacting a solvent with the aqueous suspension of microbial material, wherein the solvent is essentially immiscible in water; and (c) collecting the solvent, wherein the solvent contains lipids extracted from the aqueous suspension of microbial material.

16. The process of claim 15, wherein the step of adding the alkali raises the pH of the microbial material to between 8 and 10.

17. The process of claim 16, wherein the step of adding the alkali raises the pH of the microbial material to approximately 9.

18. The process of claim 15, further comprising the step of:

removing the lipids from the solvent.

19. The process of claim 15, further comprising the step of:

disrupting cells in the aqueous suspension of microbial material prior to collecting the solvent.

20. The process of claim 19, wherein the step of adding the alkali is after the step of disrupting cells in the aqueous suspension of microbial material.

21. The process of claim 15, further comprising the step of:

centrifuging the aqueous suspension of microbial material.

22. A process for separating lipids from microbial material, which comprises:

(a) disrupting cells in an aqueous suspension of a microbial material containing lipids;

(b) increasing the pH of the aqueous suspension to be greater than 5 after disrupting cells in the aqueous suspension;

(c) contacting a solvent with the aqueous suspension of microbial material;

(d) collecting the solvent, wherein the solvent contains lipids extracted from the aqueous suspension of microbial material and further wherein the solvent is essentially immiscible in water; and (e) separating the lipids from the solvent.

* * * * *